United States Patent [19]

Halbert

[11] Patent Number: 4,842,194

[45] Date of Patent: Jun. 27, 1989

[54] TOY ROAD BOARDS

[76] Inventor: Linda D. Halbert, 1567 Hooker Oak Ave., Chico, Calif. 95926

[21] Appl. No.: 73,090

[22] Filed: Jul. 14, 1987

[51] Int. Cl.[4] ..... E01B 23/00

[52] U.S. Cl. ..... 238/10 B; 273/157 R; 446/108

[58] Field of Search ..... 238/10 A, 10 B, 10 R, 238/10 C; 446/108; 273/157 R

[56] References Cited

U.S. PATENT DOCUMENTS 3,025,626 3/1962 Schumacher ..... 238/10 B

FOREIGN PATENT DOCUMENTS 3336927 4/1985 Fed. Rep. of Germany ... 238/10 A

*Primary Examiner*—Henry A. Bennet

[57] ABSTRACT

A toy road board for playing with toy cars and trucks. The Road board is attached in sections by velcro strips.

1 Claim, 4 Drawing Sheets

TOY ROAD BOARDS

BACKGROUND OF THE INVENTION

1. Field of the Invention:

This invention relates to toy road boards used by children to play on with toy cars and trucks. The present invention is directed towards attachable boards arranged for a continuation of road ways through country and city areas.

2. Description of the Prior Art:

Although a variety of roadway board games and housing platform structures for model trains and miniature cars are seen in past art patents, the trend is toward the game-type board, the single roadway, the speciality structure, or as backdrop features to enhance reality for model cars and model railroads. The present invention appears unique in the field of changeable road boards designed for a variety of positioning to produce various scenic locations with the same set of boards.

In past art patents examined, those seeming most interesting and pertinent to the present invention included the following:

The classes and subclasses examined were 273/157; 446/85, 93, 147, 446, 478, 476, 901; D19/64, 65; D21/109, 118, 19, 25; and 238/10. Those patents noted as being most pertinent included:

F. C. Krantz, Aug. 24, 1894, U.S. Pat. No. 524,855, folding model railway track and building boards.

J. E. Pettibone, Nov. 3, 1931, U.S. Pat. No. 1,829,963, toy highway.

C. B. Malbon, May 12, 1942, U.S. Pat. No. 2,282,871, game board with checker retaining features.

T. P. Housley, Dec. 2, 1952, U.S. Pat. No. 2,620,192, auto assembly game board.

F. B. Hall, Jr., Mar. 8, 1960, U.S. Pat. No. 2,927,396, a toy miniature bridge and overpass.

J. Modica, Jr., et al, Dec. 5, 1961, U.S. Pat. No. 3,011,787, racing game with means for mechanical movement of toy race cars.

J. F. Eyler et al, Sept. 21, 1965, U.S. Pat. No. 3,206,887, pages bound in a pad which can be torn out and fitted side by side to form roadways and different locals for moving toy cars along.

S. Kanaoki, Sept. 25, 1984, U.S. Pat. No. Des. 275,692, a hinged toy housing which can be opened to form a roadway for toy cars.

Although the J. F. Eyler et al game pad shows some similarities to the present invention, the present invention is structured with raised features embossed in the board material such as angled roads, hills, lakes, trees, houses, etc., and the boards are arranges with holding means to keep the roads aligned during use. Reading the following specifications will clearify the differences between the present invention and past art offerings, and the uniqueness of the present invention will become obvious.

SUMMARY OF THE INVENTION

In practicing my invention, it is a primary object of the invention to provide realisticly structured toy road boards which can be attached together to produce a variety of road locations.

Another object of my invention is to provide toy road boards with buildings, trees, and different ground elevations embossed in the materials of the boards.

A further object of the invention is to provide toy road boards with road ends designed so the boards can be fastened together in a variety of positions and the road ends fitted for continuation of the road from board to board.

A still further object of the invention is to provide a variety of road boards structured as different locations, town, country, etc., with means for fastening the boards together in a desired position and unfastening them again for stacking and storage.

Other objects and the unique advantages of the present invention will become better understood with a reading of the specification and numbered parts therein and comparing the numbered parts with similar numbered parts shown on the included drawings.

NUMERICAL REFERENCES

Figure 1:
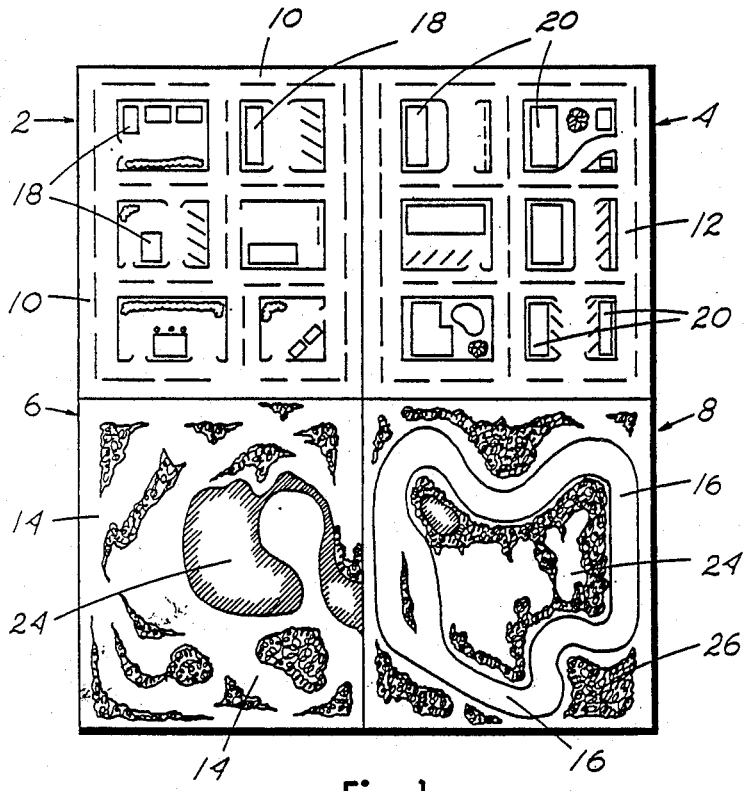
FIG. 1 is a top plan view of my toy road boards attached for use having numerical designations 2 city, 4 residential, 6 off road terrene, and 8 road race area.
Figure 2:
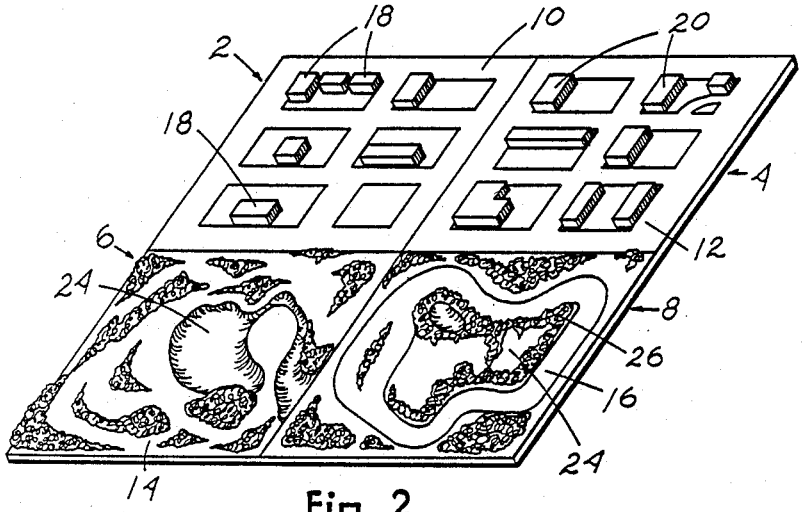
FIG. 2 shows FIG. 1 in a perspective view.

2 city board
4 residential board
6 off road area board
8 road race area board
10 city roads
12 residential roads
14 off road country roads
16 road race roads
18 city buildings
20 condos and residential buildings
22 off road hills
24 off road lake
26 road race terrene
28 corner velcro attach squares
30 rectangular velcro attach strips
32 square velcro attach center patch
34 toy car types
36 toy truck types

DESCRIPTION OF THE PREFERRED EMBODIMENTS

Figure 3:
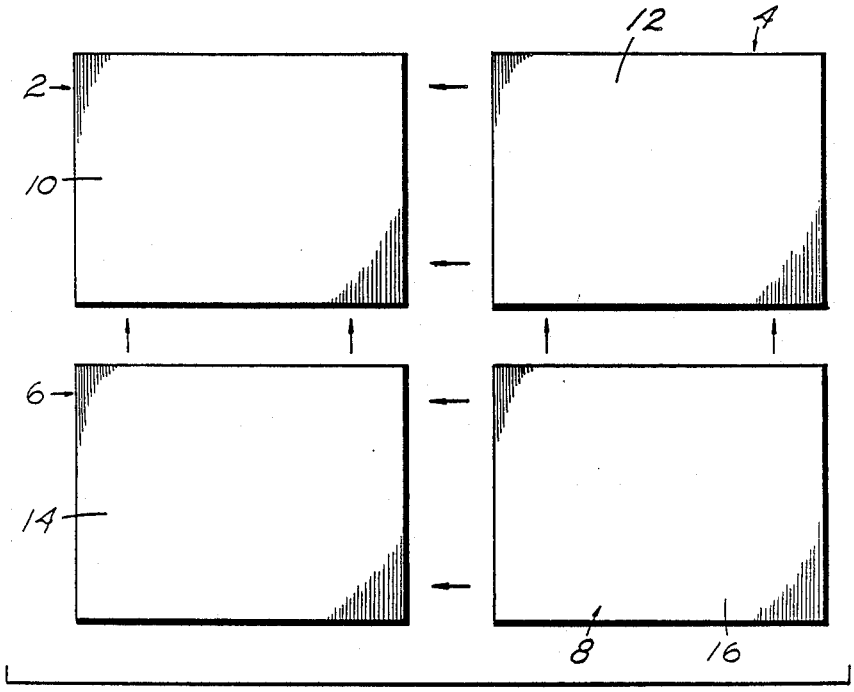
FIG. 3 is an illustration of boards 2, 4, 6, and 8 less surface details positioned for attachment.

Referring now to the drawings at FIG. 1 where four of my toy road board are shown connected in a top plan view. The city area board shown at 2 has city roads 10 passing between and around the raised structures of city buildings 18. In 4, residential roads 12 pass between and around the area structured with raised condos and residential buildings 20. At 6, off road country roads 14 wind through raised off road hills 22 around embossed off road lake 24. At 8, road race roads 16 curve through and over raised road race terrene 26. In FIG. 3, the four boards less features are shown positioned for attaching so that city roads 10 in section 2, residential roads 12 in section 4, off road country roads 14 in section 6, and road race roads in section 8 will position for pass-over use from one board to the other.

Figure 4:
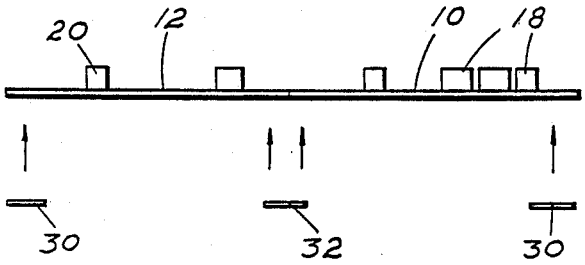
FIG. 4 illustrates the toy road boards in profile with velcro pads used for attaching the boards below, and arrows indicating attach positions.
Figure 5:
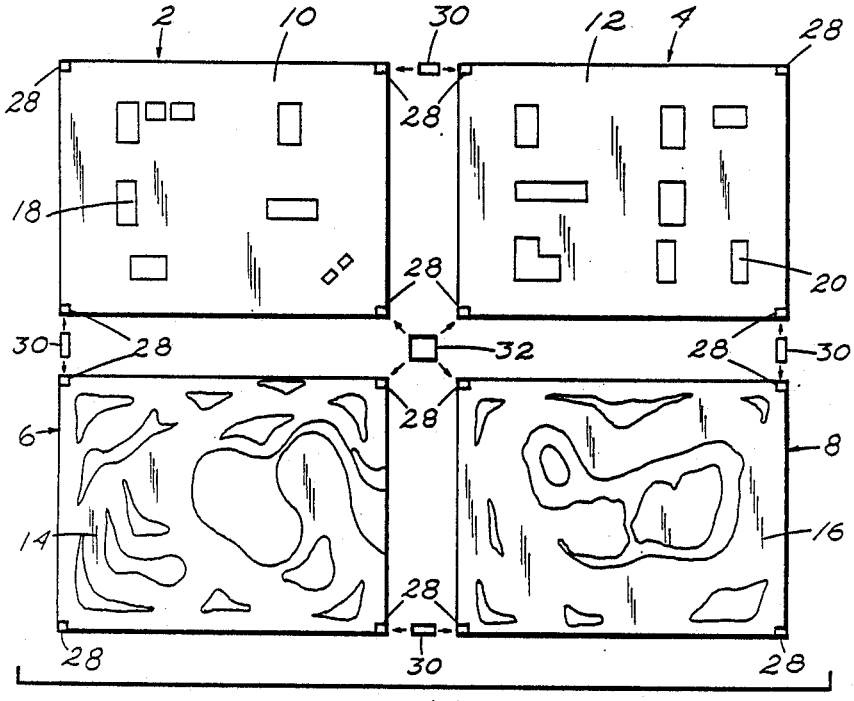
FIG. 5 illustrates the four boards described in FIG. 1 in a bottom view with velcro fittings positioned for attachment at the corners.
Figure 6:
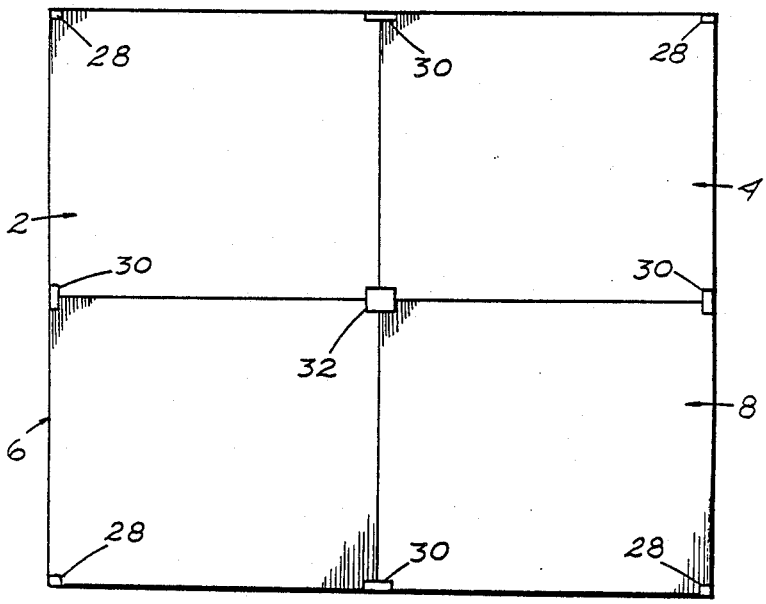
FIG. 6 is a bottom side view of four boards attached together with velcro fittings at the corners less surface details.

FIGS. 4, 5, and 6 are illustrative of the velcro attachments used to hold the toy road boards in a proper fixed position. FIG. 4 shows the boards in profile with corner rectangular velcro attach strips 30 and center square velcro attach pad 32 below the boards with arrows indicating the attach position. At In FIG. 5 the boards are shown separated and the square corner velcro pads 28 attached to all underside corners of the road boards are seen ready for securement by rectangular velcro attachments 30 along the outer edges and by square velcro center attach pad 32 in the center.

Figure 7:
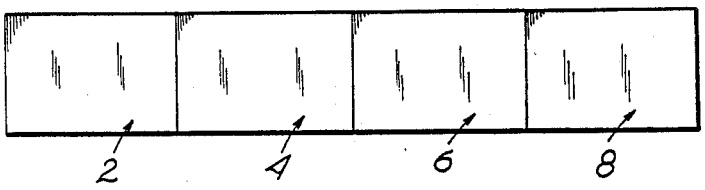
FIG. 7 illustrates the toy road boards attached in alignment less surface details.
Figure 8:
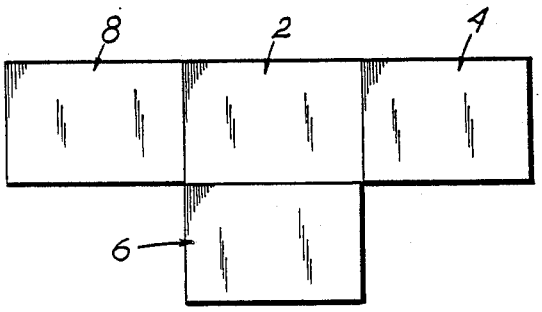
FIG. 8 illustrates the toy road boards in a T-attachment less surface details.
Figure 9:
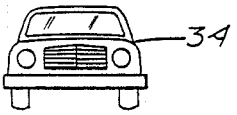
FIG. 9 shows a toy car in a frontal view illustrating a typical miniature model car for use on the toy road boards.
Figure 10:
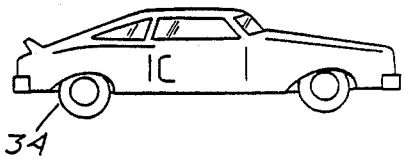
FIG. 10 shows a toy car in a side view illustrating a typical miniature model car for use on the toy road boards.
Figure 11:
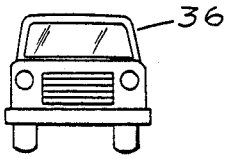
FIG. 11 shows a toy truck in a frontal view illustrating a typical miniature model truck for use on the toy road boards.
Figure 12:
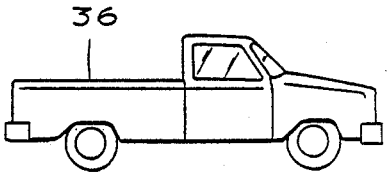
FIG. 12 shows a toy truck in a side view illustrating a typical miniature model truck for use on the toy road boards.

As the outer road endings on all boards are edgewardly directed, the toy road boards of this invention can be used in other connected combination besides square such as in alignment, or in T form as shown in FIG. 7 and 8. Off road country roads 14 will align with road race roads 16 or with residential roads 12 or city roads 10 regardless of board attachment position. Although toy vehicles most useful for the road boards of this invention are hand-sized vehicles as illustrated in FIG. 9 through 12, most any small toy auto or truck will suffice. Each road board is structured of strong plastic with the raised terrene and building embossed therein. Damaging them is quite difficult even during rough usage. As playthings, the toy boards constituting the invention are provided to enhance the user's imagination.

Although I have described by invention with considerable details in the specification, it is to be understood that I may practice modifications in the design and structure which do not depart from the intended scope of the appended claims.

What is claimed is:

1. Attachable toy road boards, comprising:

substantially rectangular plastic panels having upwardly oriented surfaces as top sides embossed microcosmically into connectable roadways coursed through realistic geographical areas, said panels having downwardly oriented surfaces as bottom sides;

velcro tabs of substantially square configuration affixed on said bottom sides of said panels to the corners thereof being arranged for removable attachment of said panels edge to edge by connective free pads of velcro in rectangular and square shapes fastening said corner affixed velcro tabs to each other with said removable attachment allowing repositioning of said panels making said toy road board useful in a variety of positions and providing continuing road connections for said connectable roadways;

said geographical areas including:

miniature replicas of buildings, city streets, and city features of said embossed panels designated city boards;

miniature replicas of residential homes, streets, landscaping, and residential features on said embossed panels designated residential boards;

miniature replicas of off-road dirt streets, lakes, and camp areas on said embossed panels designated off-road boards;

miniature replicas of a road race track with pit area, lake, and race area structures on said embossed panels designated road race boards;

miniature replicas of a variety of other localities on said embossed panels affixed with said connectable roadways arranged to align with said panels adjacent in various placements and said panels affixed on said bottom sides with said velcro corner tabs for said removable attachment by said connective fastening of said velcro corner tabs by said free pads of velcro.

* * * * *